US005517299A

United States Patent [19]

Teratani et al.

[11] Patent Number: 5,517,299

[45] Date of Patent: May 14, 1996

[54] APPARATUS AND METHOD FOR EXAMINING KEY PLATES

[75] Inventors: Tatsuo Teratani, Aichi; Yasuo Mishima, Hekinan; Tsuyoshi Katayama, Yokohama, all of Japan

[73] Assignee: Toyota Jidosha Kabushiki Kaisha, Toyota, Japan

[21] Appl. No.: 214,322

[22] Filed: Mar. 17, 1994

[30] Foreign Application Priority Data

Mar. 19, 1993 [JP] Japan ..... 5-060783
Mar. 4, 1994 [JP] Japan ..... 6-035091

[51] Int. Cl.[6] ..... G07C 11/00

[52] U.S. Cl. ..... 356/71; 356/394

[58] Field of Search ..... 356/71, 394

[56] References Cited

U.S. PATENT DOCUMENTS 3,797,936 3/1974 Dimitriadis ..... 356/71
4,079,605 3/1978 Bartels ..... 356/71
4,283,859 8/1981 Roland .

FOREIGN PATENT DOCUMENTS 0053730 6/1982 European Pat. Off. .
2489535 3/1982 France .
58-019832 4/1983 Japan .
673612 3/1990 Switzerland .

*Primary Examiner*—Richard A. Rosenberger
*Attorney, Agent, or Firm*—Cushman, Darby & Cushman

[57] ABSTRACT

A key plate examination apparatus and examination method whereby the form of an examined key plate can be recognized accurately and form information of a reference key plate can be compared with the recognized key plate form to determine their conformity rapidly. The form of the examined key plate is recognized by form recognition means, and form information is generated by form information generation means in response to the recognized form of the examined key plate. On the other hand, form information of the key number corresponding to a key number input externally is retrieved by key number retrieval means from a key information memory means storing the key number proper to the reference key plate and its corresponding form information. The form information generated by the form information generation means is compared with the form information retrieved by the key number retrieval means to determine their conformity by determination means. The operator is informed of the determination result of the determination means by communication means.

22 Claims, 14 Drawing Sheets

APPARATUS AND METHOD FOR EXAMINING KEY PLATES

BACKGROUND OF THE INVENTION

1. Field of the Invention

This invention relates to an apparatus and method for examining key plates, and, in particular, to an apparatus and method for examining key plates by comparing the form of a key plate being examined with the form of a reference key plate and the specification values for determination.

2. Description of the Related Art

It is known to represent the form of a key plate, such as an ignition key of a car, the undulation dimensions of mountain-and-valley-like irregularities of the key plate, and their combination as a key code consisting of a plurality of digits. Car manufacturers have prepared and managed the key plates for each car based on the key codes. On the other hand, key manufacturers and car manufacturers need to display key codes, which indicates form information of key plates, on the key plates for preparing spare keys, etc., while preventing outsiders from easily reproducing the key plates. Therefore, in fact, the key numbers (symbols corresponding to the key codes on a one-to-one basis) prepared based on the key code collation tables owned by the key manufactures and the car manufacturers are represented on the key plates.

To examine whether or not each key plate thus prepared and managed has a combination of irregularities as its key code and whether or not the irregular form is machined within the tolerance of the form specification values, for example, the dimensions of the key plate are directly measured with measuring instruments, such as slide calipers and micrometers, or the key plate is projected by a projector and the key plate dimensions are calculated. The measured dimensions are then collated with the dimensions on a work drawing and form information of the key code retrieved according to the key number displayed on the key plate in order to examine the key plate form. For example, disclosed in Japanese Patent Publication No. Sho 58-19832 is a key code display device which brings a plurality of styli into contact with the irregularities of a key plate, calculates a key code in response to the displacement amount of the styli, and displays the key code.

Thus, the key plate dimensions and key code detected in contact or non-contact with a key plate are collated with an enormous amount of key information of reference key plates listed in collation tables.

However, the conventional key plate form examination requires comparison or collation of form information, such as the dimensions and combination of irregularities of the key plate, measured with form information of the reference key plates provided from key code collation tables and work drawings. As a result, it takes a long time to examine the key plates and an error is prone to occur in comparison or collation because of the large amount of key plates which differ slightly in form.

When the key plate form is measured with contact measuring instruments such as slide calipers and micrometers or styli, it is difficult to eliminate completely measurement errors. As a result, a proper determination as to whether or not the measured dimensions match the dimension specification values cannot be made.

SUMMARY OF THE INVENTION

It is therefore an object of the present invention to provide an apparatus and method for examining key plates, whereby the form of a key plate can be recognized accurately and form information, such as the dimensions and combination of irregularities of a reference key plate represented as key code, can be compared with the recognized key plate form to determine their conformity rapidly.

To this end, according to the first aspect of the invention, as shown in FIG. 1, there is provided a key plate examination apparatus for comparing form information of a key plate to be examined with form information of a reference key plate to determine the conformity therewith. The examination apparatus comprising means (a) for recognizing a form of the examined key plate, memory means (b) for storing key information consisting of form information associated with each reference key plate form and a key number corresponding to the form information, means (c) for retrieving, responsive to a key number input externally, form information corresponding to the input key number from the key information memory means (b), means (d) for generating form information in response to the examined key plate form recognized by the form recognition means (a), determination means (e) for comparing the form information generated by the form information generation means (d) with the form information retrieved by the key number retrieval means (c) to determine their conformity, and means (f) for communicating the determination result of the determination means (e).

According to the invention, there is provided a key plate examination method by comparing form information of a key plate to be examined with form information of a reference key plate to determine the conformity therebetween. The method comprising the steps of recognizing a form of the examined key plate, responsive to a key number input externally, retrieving form information corresponding to the input key number from a memory means which stores key information consisting of form information proper to each reference key plate form and a key number corresponding to the form information, generating form information in response to the examined key plate form recognized at the form recognizing step, and comparing the form information generated at the form information generating step with the form information retrieved at the form information retrieving step to determine their conformity.

According to the second aspect of the invention, as shown in FIG. 2, there is provided a key plate examination apparatus for comparing form information of a key plate to be examined with form information of a reference key plate to determine the conformity therebetween. The examination apparatus comprising means (a) for recognizing a form of the examined key plate, memory means (b) for storing key information consisting of form information proper to each reference key plate form and a key number corresponding to the form information, means (d) for generating form information in response to the examined key plate form recognized by the form recognition means (a), means (g) for retrieving predetermined form information and a key number corresponding to the form information from the key information memory means (b) in response to the form information generated by the form information generation means (d), means (h) for comparing the form information of the examined key plate generated by the form information generation means (d) with the form information retrieved by the form retrieval means (g) to determine their conformity, and means (f) for communicating the determination result of the determination means (h).

According to the invention, there is provided a key plate examination method by comparing form information of a key plate to be examined with form information of a reference key plate to determine the conformity therebetween. The method comprising the steps of recognizing a form of the examined key plate, generating form information in response to the examined key plate form recognized at the form recognizing step, retrieving predetermined form information and a key number corresponding to the form information from a memory means which stores key information consisting of form information proper to each reference key plate form and a key number corresponding to the form information in response to the form information generated at the form information generating step, and comparing the form information of the examined key plate generated at the form information generating step with the form information retrieved at the form information retrieving step to determine their conformity.

According to the third aspect of the invention, as shown in FIG. 3, there is provided a key plate examination apparatus for comparing form information of a key plate to be examined with form information of a reference key plate to determine the conformity therebetween. The examination apparatus comprising means (a) for recognizing a form of the examined key plate, memory means (i) for storing feature information proper to each reference key plate type, another memory means (b) for storing key information consisting of form information proper to each reference key plate form and a key number corresponding to the form information, means (j) for determining a type of the examined key plate, means (k) responsive to the determination result of the key type determination means (j) for retrieving feature information corresponding to the examined key plate from the feature memory means (i), means (l) for generating feature form information from the feature information retrieved by the feature retrieval means (k) and the form information recognized by the form recognition means (a), means (m) for retrieving predetermined form information and a key number corresponding to the form information from the key information memory means (b) in response to the feature form information generated by the feature form information generation means (l), feature determination means (n) for comparing the form information generated by the feature form information generation means (l) with the form information retrieved by the feature form retrieval means (m) to determine their conformity, and means (f) for communicating the determination result of the feature determination means (n).

According to the invention, there is provided a key plate examination method by comparing form information of a key plate to be examined with form information of a reference key plate to determine the conformity therebetween. The method comprising the steps of recognizing a form of the examined key plate, determining a type of the examined key plate, responsive to the determination result of the key type determining step, retrieving feature information corresponding to the examined key plate from a memory means which stores feature information proper to each reference key plate type, generating feature form information from the feature information retrieved at the feature information retrieving step and the form information recognized at the form recognizing step, retrieving predetermined form information and a key number corresponding to the form information from a memory means which stores key information consisting of form information proper to each reference key plate form and a key number corresponding to the form information in response to the feature form information generated at the feature form information generating step, and comparing the form information generated at the feature form information generating step with tile form information retrieved at the feature form retrieving step to determine their conformity.

According to the invention, the form of the examined key plate is recognized by the form recognition means (a). Subsequently, form information is generated by the form information generation means (d) in response to the examined key plate form recognized by the recognition means (a). On the other hand, form information of the key number corresponding to a key number entered externally is retrieved by the key number retrieval means (c) from the key information memory means (b) which stores the key number proper to a reference key plate and its corresponding form information. The form information generated by the form information generation means (d) is compared with the form information retrieved by the key number retrieval means (c) to determine their conformity by the determination means (e). Further, the operator is informed of the determination result of the determination means (e) by the communication means (f). Therefore, the form, such as the dimensions and combination of irregularities of the reference key plate, can be compared with the form of the examined key plate to determine their conformity rapidly.

According to the invention, the form of the examined key plate is recognized by the form recognition means (a). Subsequently, form information is generated by the form information generation means (d) in response to the examined key plate form recognized by the recognition means (a). Predetermined form information and a key number corresponding to the form information are retrieved from the key information memory means (b) by the form retrieval means (g) in response to the form information of the examined key plate. Further, the form information generated by the form information generation means (d) is compared with the form information retrieved by the form retrieval means to determine their conformity by the determination means (h). Then, the operator is informed of the determination result of the determination means (h) by the communication means (f), and form estimation is made based on the form of the examined key plate. Therefore, even if form information concerning the examined key plate is unknown, form estimation is made based on the form of the examined key plate and the form, such as the dimensions and combination of irregularities, of the reference key plate can be compared with the form of the examined key plate to determine their conformity rapidly and easily.

Further, according to the invention, the form of the examined key plate is recognized by the form recognition means (a). The type of examined key plate is determined by the key type determination means (j), and feature information of the examined key plate is retrieved from the feature memory means (i) by the feature retrieval means (k) in response to the determination result. Feature form information is generated by the feature form information generation means (l) from the feature information retrieved by the feature retrieval means (k) and the form information recognized by the form recognition means (a). Further, predetermined form information and a key number corresponding to the form information are retrieved from the key information memory means (b) by the feature form retrieval means (m) in response to the feature form information generated by the feature form information generation means (l). Then, the form information generated by the feature form information generation means (l) is compared with the form information retrieved by the feature form retrieval means (m) to determine their conformity by the feature determination means (n). The operator is informed of the determination result of the feature determination means (n) by the communication means (f), and the form of the examined key plate can be estimated with respect to feature points of the examined key plate for efficient examination. Therefore, even if form information concerning the examined key plate is unknown, the form, such as the dimensions and combination of irregularities, of the reference key plate can be compared with the form of the examined key plate to determine their conformity more rapidly and easily.

DESCRIPTION OF THE PREFERRED EMBODIMENTS

Referring now to the accompanying drawings, there are shown preferred embodiments of the invention.

Figure 1:
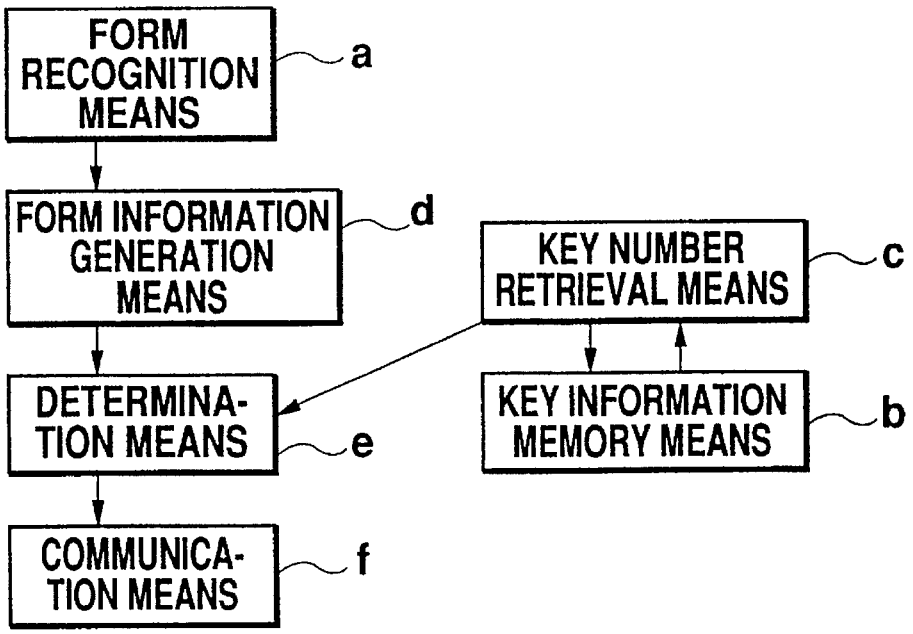
FIG. 1 is a block diagram of the first embodiment of the present invention.
Figure 2:
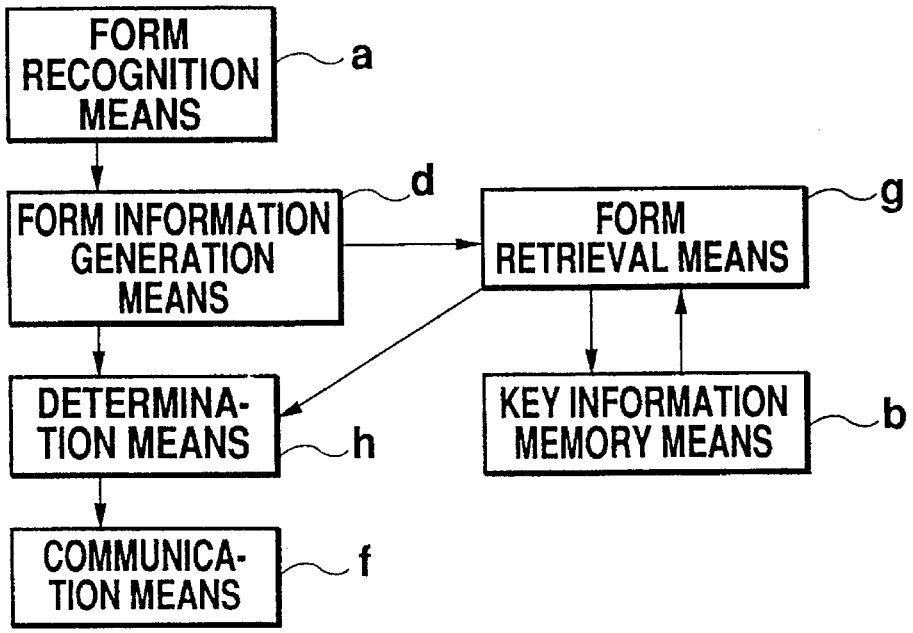
FIG. 2 is a block diagram of the second embodiment of the present invention.
Figure 3:
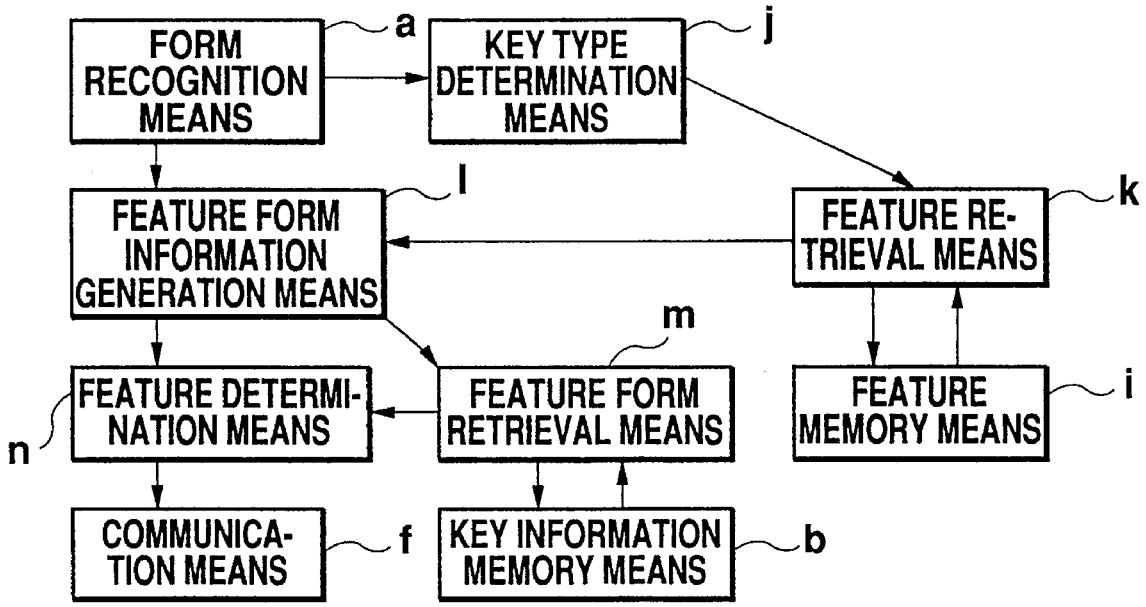
FIG. 3 is a block diagram showing another process of the second embodiment of the present invention.
Figure 4:
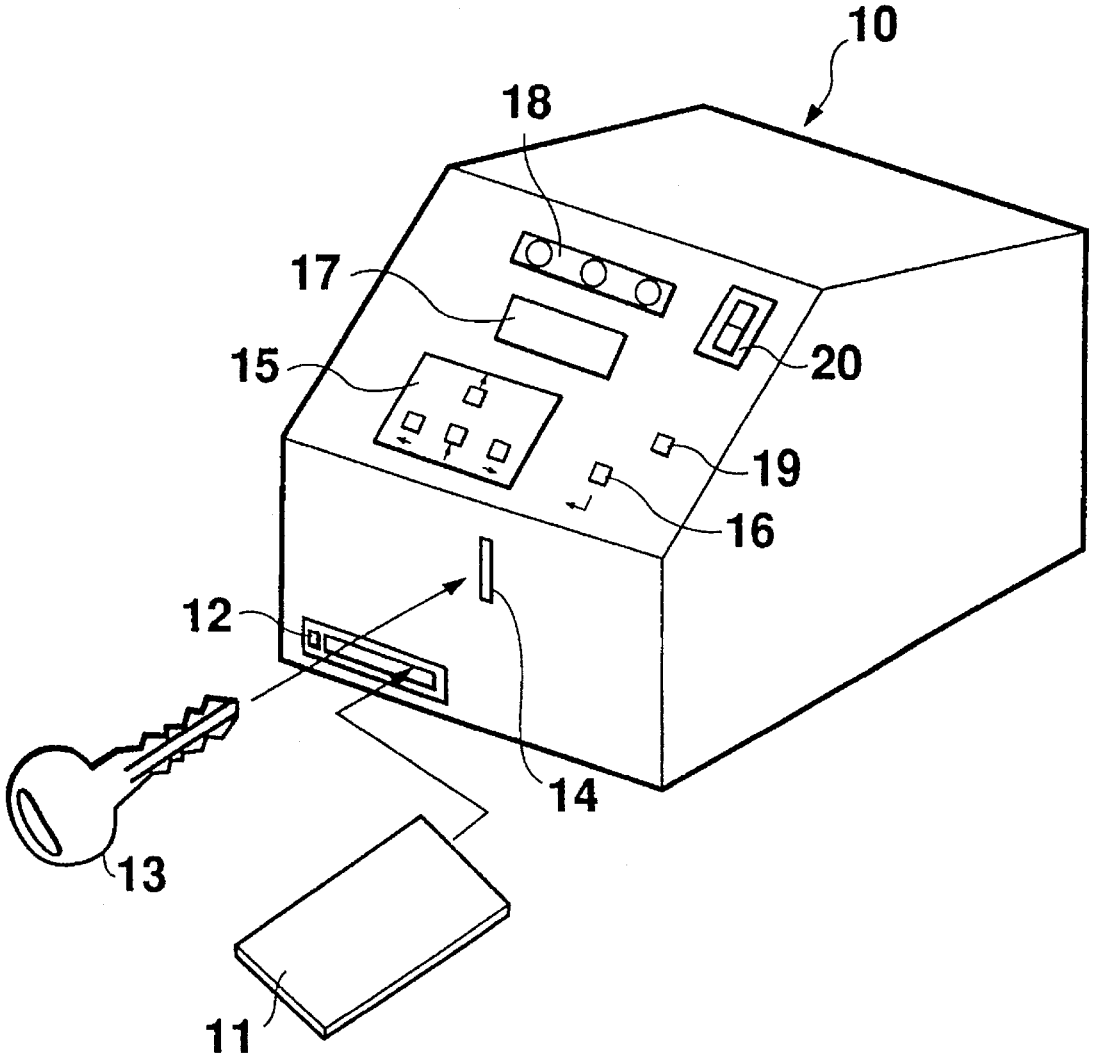
FIG. 4 is an external perspective view showing a key plate examination apparatus according to a first embodiment of the invention.

FIG. 4 shows an external perspective view of a transmission-type key plate examination apparatus according to a first embodiment of the invention.

An IC card slot 12 for inserting an IC card 11 is disposed on the front of key plate examination apparatus 10 for examining the form of a key plate, such as an ignition key of a car. The IC card 11 contains a key information memory means (memory) of reference key plates which stores key numbers prepared based on a key code collation table owned by a key manufacturer (symbols corresponding to the key codes specifying the forms of key plates on a one-to-one basis) and form information of the key plates corresponding to the key numbers (information such as undulation dimensions of mountain-and-valley-like irregularities of the key plates represented by the key codes, allowable errors, and combinations of irregularities). Preferably, the key information memory means is a memory that can be rewritten or updated to cope with an increase in the types of key plates because of an increase in the number of manufactured cars and introduction of new model cars. Located near the IC card slot 12 is a key plate slot 14 for inserting the mountain-and-valley-like irregular portion of a key plate to be examined (simply, key plate) 13.

Located near the key plate slot 14 is a liquid crystal panel 17 as communication means for providing key information. In response to display on the liquid crystal panel 17, the operator enters the key number attached to the key plate 13 using cursor keys 15 and a return key 16. Further, the key plate examination apparatus 10 has an LED display section 18 as communication means for informing the operator of the result of key plate form examination. The LED display section 18 indicates the examination result in LED color, such as red indicating failure, yellow indicating caution, and green indicating pass. In addition, components such as an examination start switch 19 and a main power switch 20 are disposed on the front of the key plate examination apparatus 10.

Figure 5:
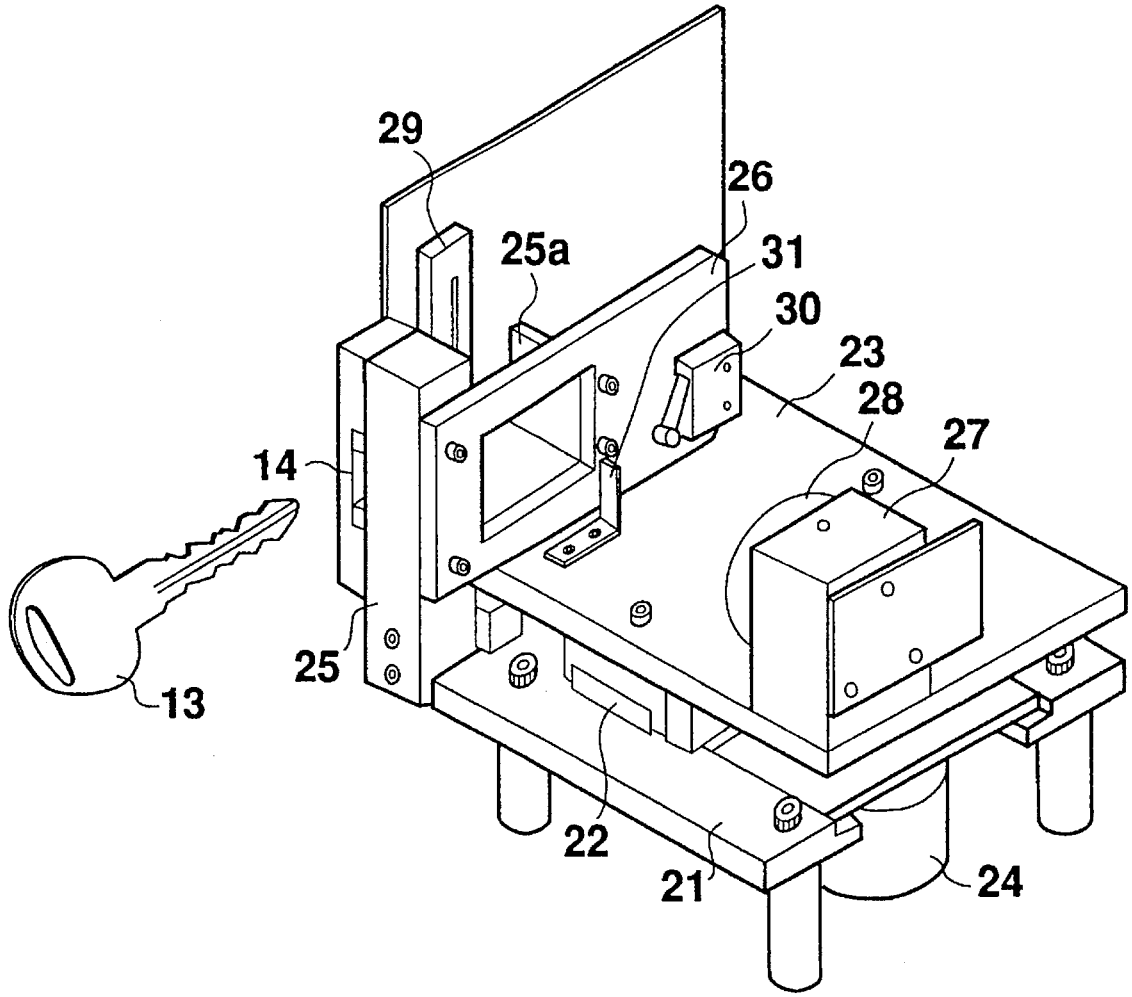
FIG. 5 is a schematic perspective view showing a mechanism of the key plate examination apparatus according to the first embodiment of the invention.

FIG. 5 shows a schematic perspective view of a mechanism of the key plate examination apparatus 10.

A slide rail 22 is fixed on the top of a base plate 21 and a main table 23 is disposed slidably via the slide rail 22. The base plate 21 is formed with a table moving motor 24 for moving the main table 23 and the rotary driving force of the table moving motor 24 is converted into a horizontal moving force of the main table 23 by drive transmission means such as a α- wind belt and ball screws (not shown). The table moving motor 24 can perform accurate pitch feed of the main table 23 when the key plate form is examined using a stepping motor, etc., for example, whereby form data of the key plate 13 for each pitch can be read accurately. Further, the base plate 21 has one end formed with a key plate fixing portion 25 for fixing the key plate 13 to an examination position and a key stopper 25*a* via a bracket 26. The key plate 13 can always be fixed to the same position by striking the tip of the key plate 13 against the key stopper 25*a*. On the other hand, fixed on the top of the slidably located main table 23 are a laser light emitting section 27, a lens holder having an aspheric lens for converting light of the laser light emitting section 27 into parallel light, and a CCD (charge-coupled device) linear sensor 29 which receives the parallel light, a part of which is cut off by the key plate 13 fixed to the key plate fixing portion 25, which are spaced from each other as predetermined for making up a key form detection section of form recognition means.

In addition, the bracket 26 is formed with a sensor 30 for outputting a timing signal of starting examination of the key plate 13 (in the embodiment, microswitch 30). The microswitch 30 abuts a sensor dog 31 located on the main table 23, thereby outputting an on/off signal as the timing signal.

Figure 6:
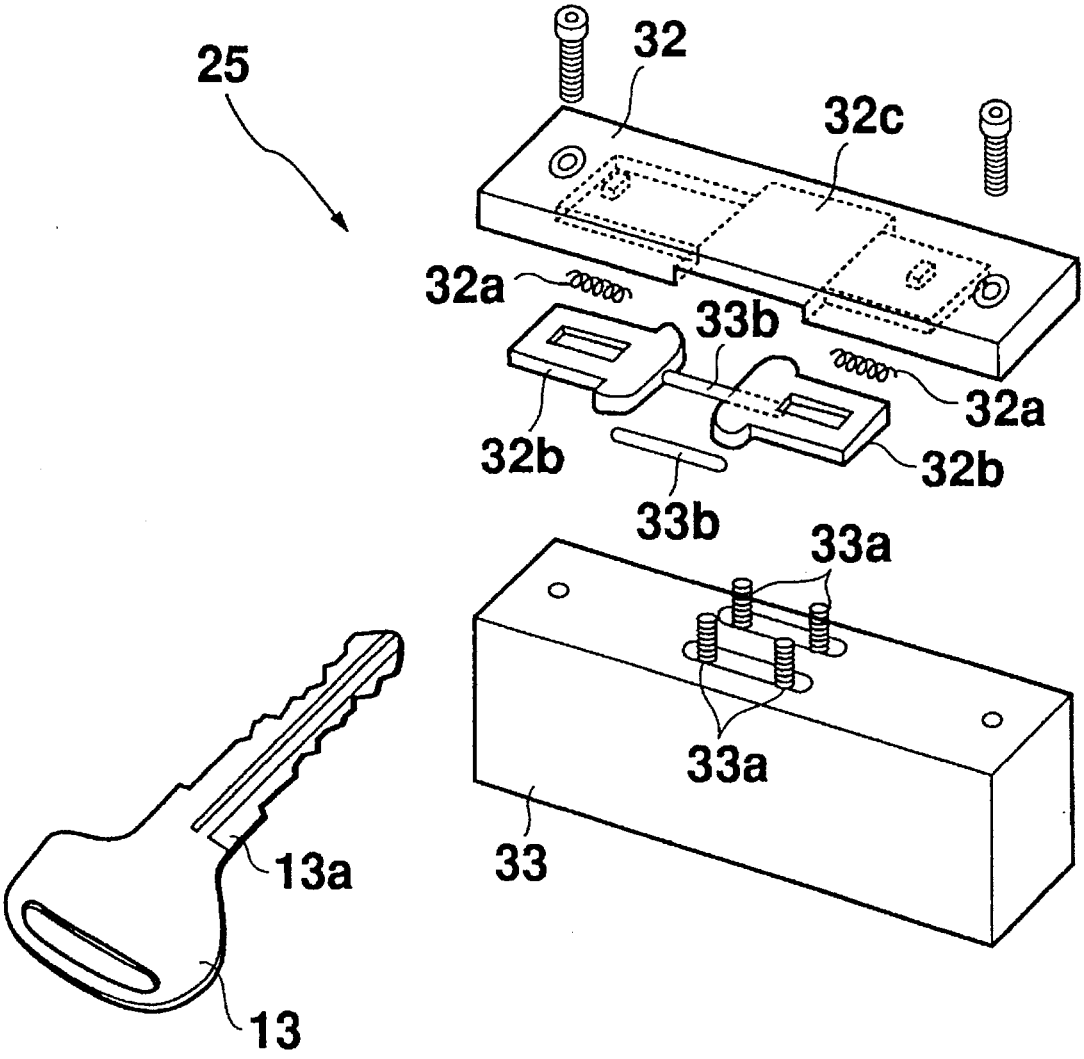
FIG. 6 is an exploded perspective view of a structure of a key plate fixing portion of the key plate examination apparatus according to the invention.

FIG. 6 shows a key clamp structure of the key plate fixing portion 25.

An even portion 13*a* of the key plate 13 inserted into the key plate fixing portion 25 is clamped from both the left and right directions by slide plates 32*b* energized in the center direction by springs 32*a* housed in an upper key clamp 32. The key plate 13 is also energized in the thickness direction (top and bottom direction) onto the top end face of a groove 32*c* located in the upper key clamp 32 by two rollers 33*b* energized upward by four roller springs 33*a* housed in a lower key clamp 33. Thus, the key plate 13 can be secured in the left and right and top and bottom directions.

Figure 7:
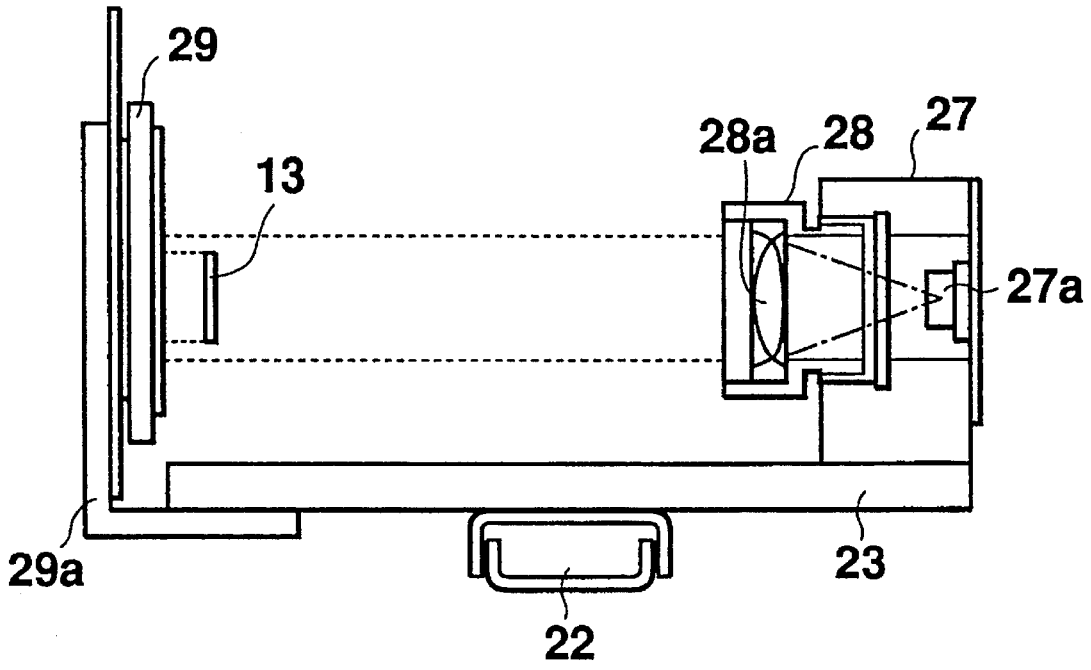
FIG. 7 is a side view of a key form detection section of the key plate examination apparatus according to the first embodiment of the invention.

FIG. 7 shows a side view of the key form detection section. As described above, the main table 23 on which the laser light emitting section 27 and the lens holder 28 are placed and which further has the bracket 29*a* to which the CCD linear sensor 29 is fixed is disposed on the slide rail 22 slidably in the depth direction in FIG. 7. Light emitted from a laser diode 27*a* in the laser light emitting section 27 is passed through the aspheric lens 28*a* of the lens holder 28 located in front of the laser light emitting section 27 for conversion to parallel light, then the key plate 13 inserted onto a light path in front of the lens holder 28 is irradiated with the parallel light. At this time, the CCD linear sensor 29 reads the shaded portion made by the key plate 13 and direct light of the laser diode 27*a*. Therefore, the shade and direct light are converted by the CCD into electric signals in picture element units (several μm). The main table 23 is moved in the length direction of the key plate (in the depth direction in FIG. 7) by drive of the table moving motor (not shown), thereby accurately measuring the form of the key plate 13 in the CCD picture element units (several μm). At this time, if the data read timing of the CCD linear sensor 29 is controlled by a timing signal responsive to driving the table moving motor, the accurate form of the key plate 13 can be obtained in a desired measurement pitch.

Figure 8:
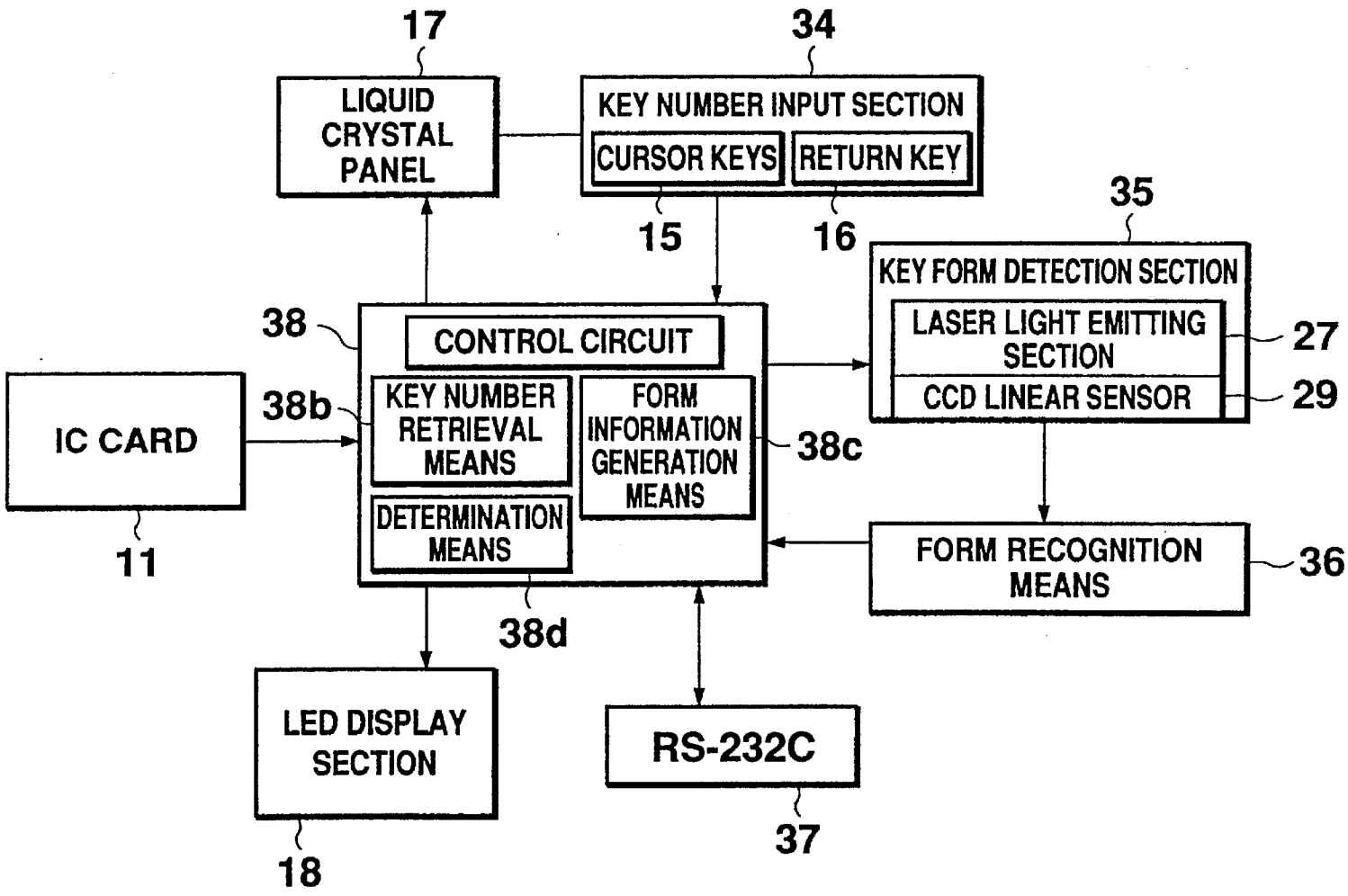
FIG. 8 is a block diagram of a key information processing section of the key plate examination apparatus according to the first embodiment of the invention.
Figure 9:
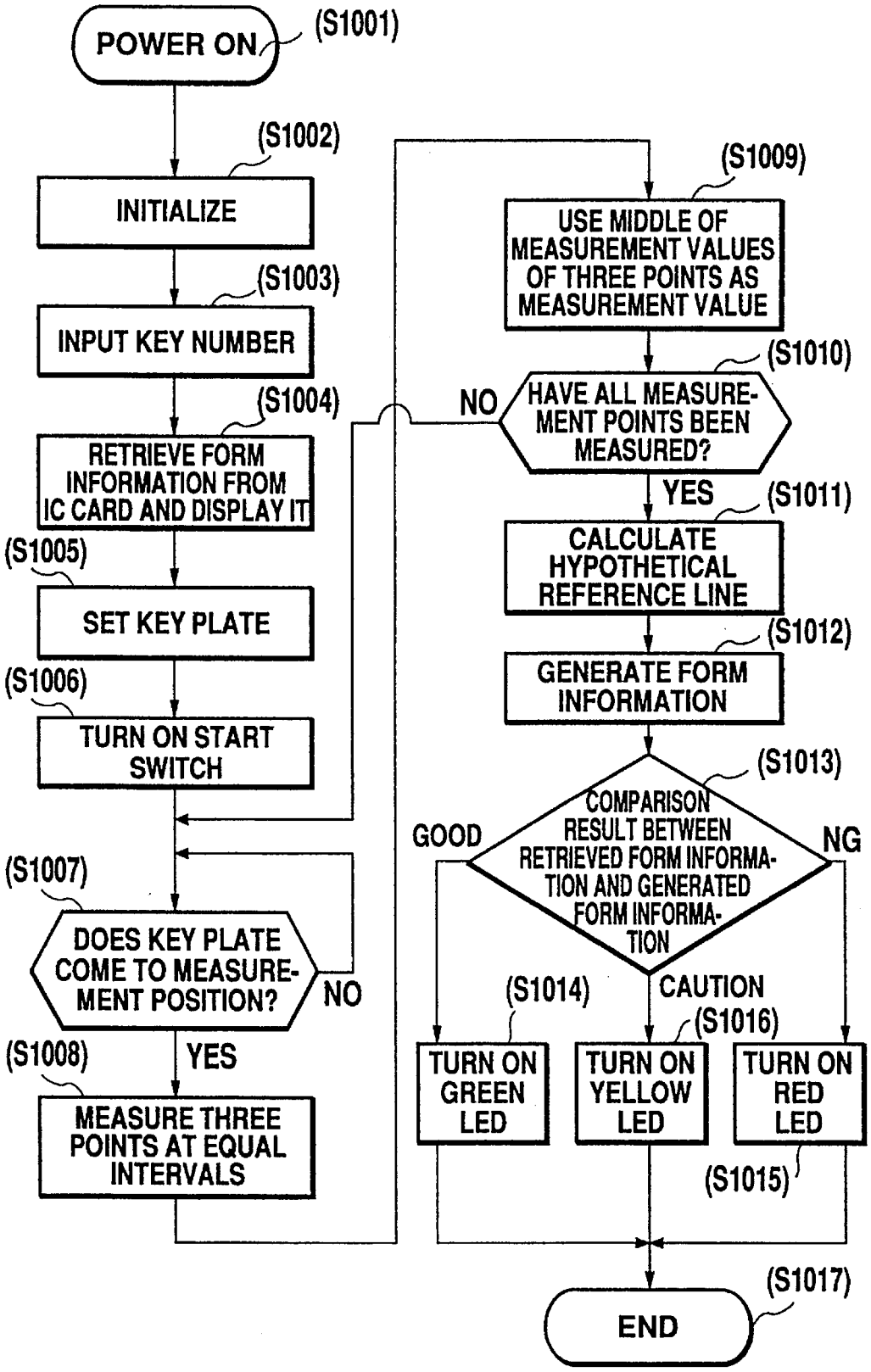
FIG. 9 is a flowchart of the operation of the key information processing section of the key plate examination apparatus according to the first embodiment of the invention.

FIG. 8 shows a block diagram of a key information processing section of the key plate examination apparatus. The operation of the key plate examination apparatus is described with reference to FIGS. 4 to 7 and 9 (flowchart) in addition to FIG. 8.

The key information processing section comprises a key number input section 34, liquid crystal panel 17, IC card 11, key form detection section 35, form recognition means 36, LED display section 18, RS-232C interface 37 (for production control), control section 38, etc.

First, the IC card 11 containing a key information memory storing the key number of the key plate 13 to be examined and its corresponding key code is inserted into the IC card slot 12 in FIG. 4, then the main power switch 20 is turned on at step S1001 to initialize the examination apparatus at step S1002.

The key number input section 34 is formed with the cursor keys 15 and the return key 16 for the operator to enter the key number attached to the key plate 13 in response to display on the liquid crystal panel 17. The key number is input through the key number input section 34 to the control section 38 at step S1003. When the key number is input, the control section 38 retrieves form information corresponding to the input key number, such as undulation dimensions of mountain-and-valley-like irregularities of the reference key plate, allowable error, and a combination of the irregularities as key code, from the IC card 11 which stores a large number of pairs of the key numbers and their corresponding form information by key number retrieval means 38*b* in the control section 38, and displays the retrieved form information on the liquid crystal panel 17 at step S1004.

Next, the key plate 13 is inserted through the key plate slot 14 into the key plate fixing section 25 for fixing the key plate 13 at step S1005. At this time, the key plate 13 is inserted securely until it abuts tile key stopper 25*a* for accurate positioning.

On the other hand, the key form detection section 35, which has the laser light emitting section 27 and the CCD linear sensor 29, irradiates the key plate 13 inserted into the light path formed by the laser light emitting section 27 and CCD linear sensor 29 with laser light of the laser light emitting section 27, and detects the resultant light and shade by the CCD linear sensor 29.

When the examination start switch 19 is turned on at step S1006, the key form detection section 35 starts to move in the length direction of the key plate 13 by a predetermined move method of the stepping motor 24, α-wind belt, etc., as described above. At this time, the CCD linear sensor 29 collects the key plate form in sequence as electric signal in picture element units at any desired measurement position on the key plate 13 according to the timing signal responsive to the travel distance of the key form detection section 35 at step S1007.

Figure 10:
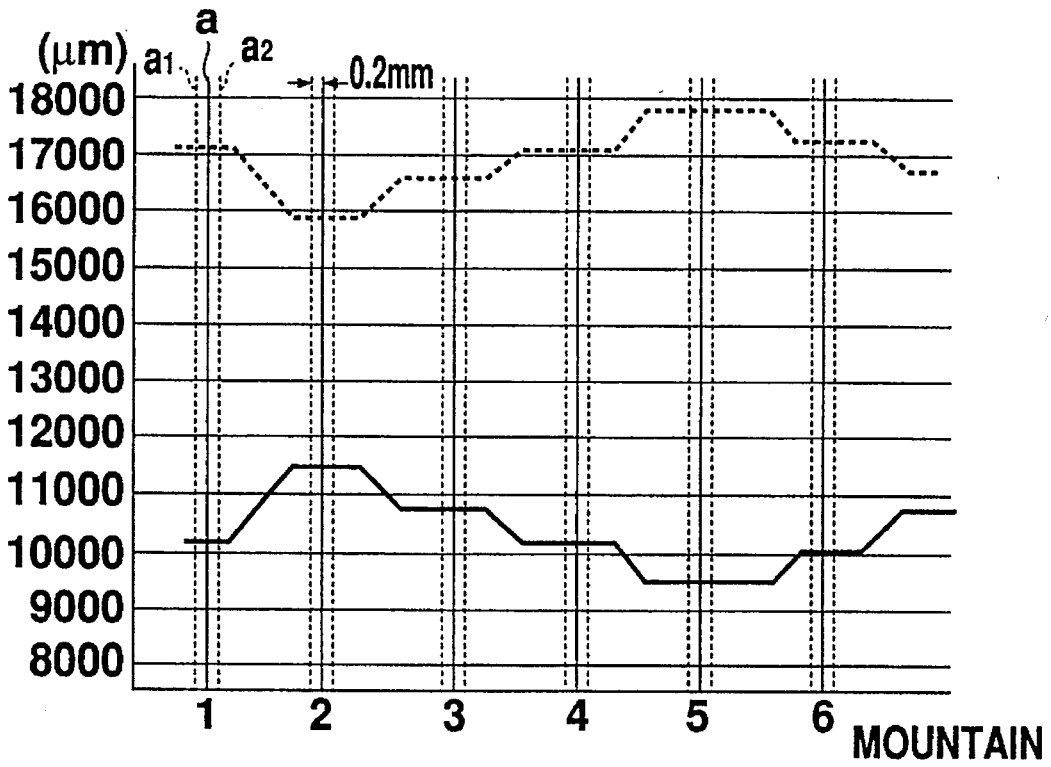
FIG. 10 is a graph showing a measurement example of the key plate examination apparatus according to the invention.

When the mountain-and-valley-like form of the key plate is collected as electric signal in picture element units, a plurality of points are measured for a single peak and the intermediate value thereof is adopted as the measurement value, thereby excluding erroneous values occurring at the measurement. That is, the peak center and two points before and behind it, a1, a, and a2, (three points in total) are measured, as shown in FIG. 10. For example, assume that the position of the peak to be measured is 10 mm distant from the tip and that the three points are spaced 0.2 mm from each other. If the measurement values at the three points a1=9.8, a=10, and a2=10.2 mm are 4.02, 4.01, and 4.03 respectively, 4.02 is adopted as the measurement value (steps 1008 and 1009). Steps S1007–S1009 are executed for all of the predetermined measuring points over the whole of the key plate. After completion of measurement for all of the predetermined points, operation proceeds to step S1010.

Figure 11:
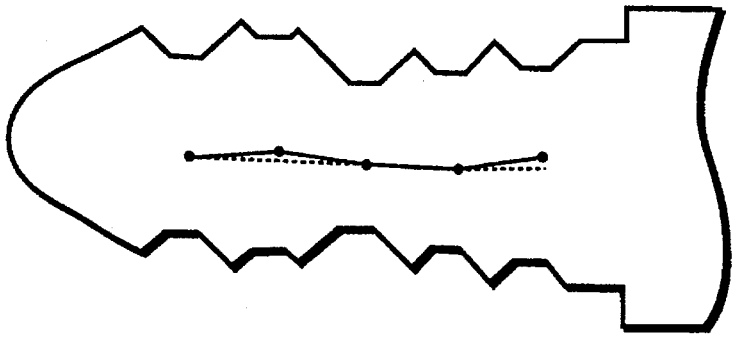
FIG. 11 is an illustration showing a hypothetical center line of the key plate examination apparatus according to the invention.

As shown in FIG. 11, when a reversible key (key plate whose irregularities are vertically symmetrical in the width direction and whose top or bottom direction need not be considered when the key plate is inserted) has a dimension shift in opposite directions by the same dimension in the top and bottom directions of the key plate (for example, 0.1 mm long upward from the center of the key plate and 0.1 mm short downward from the center), if only the width of the key plate is measured and a comparison is made, the key plate enters the allowable error range as width precision and is judged to pass the examination. In fact, the key plate center shifts as indicated by the solid line in FIG. 11, thus the key plate must be rejected. Therefore, a hypothetical center (hypothetical reference line) calculated by primary regression of a statistical technique is found as indicated by the dotted line in FIG. 11 and the dimensions of the irregularities are calculated upward and downward from the key plate center with the hypothetical center (hypothetical reference line) as reference, thereby providing measured key plate information (form information) nearer to the actual values (S1011).

The electric signals in picture element units collected by the CCD linear sensor 29 are subjected to signal processing such as binarization by the form recognition means 36 for recognizing the form of the key plate in several μm units, and the result is input to form information generation means 38*c* in the control section 38. The form information generation means 38*c* is responsive to the input data for generating form information of the key plate, such as undulation dimensions of mountain-and-valley-like irregularities of the key plate and a combination of the irregularities at step S1012.

Next, the form information generated by the form information generation means 38*c* is compared with the form information retrieved by the key number retrieval means 38*b*, such as undulation dimensions of mountain-and-valley-like irregularities of the reference key plate, allowable error, and a combination of the irregularities, by determination means 38*d* at step S1013. As a result of the comparison, if the form of the key plate 13 is within the allowable error range of the reference key plate, the determination means 38*d* turns on a green LED on the LED display section 18 to indicate that the key plate 13 passes the form examination at step S1014. If the form of the key plate 13 is outside the allowable error range of the reference key plate, the determination means 38*d* turns on a red LED on the LED display section 18 to indicate that the key plate 13 fails the form examination at step S1015. At the time, if the determination as to whether it is good or bad is on the line, a yellow LED may be turned on as means for calling operator's attention to trouble at key plate formation or examination, such as key cutter abrasion, improper key cutting method, or unskilled examination operation, at step S1016. In the embodiment, key information can be input/output by using the RS-232C interface 37 disposed as one of communication means shown in FIG. 8 as required for production control of key plates at full-scale production.

When the examination of the key plate 13 ends at step S1017 and a new key plate is examined, a clear key (not shown) is pressed or the power switch 20 is again turned on for clearing the examination result for initialization at step S1002. The same steps for examination may be repeated by inputting a key number, or alternatively, it may be set to continue automatically.

Figure 12:
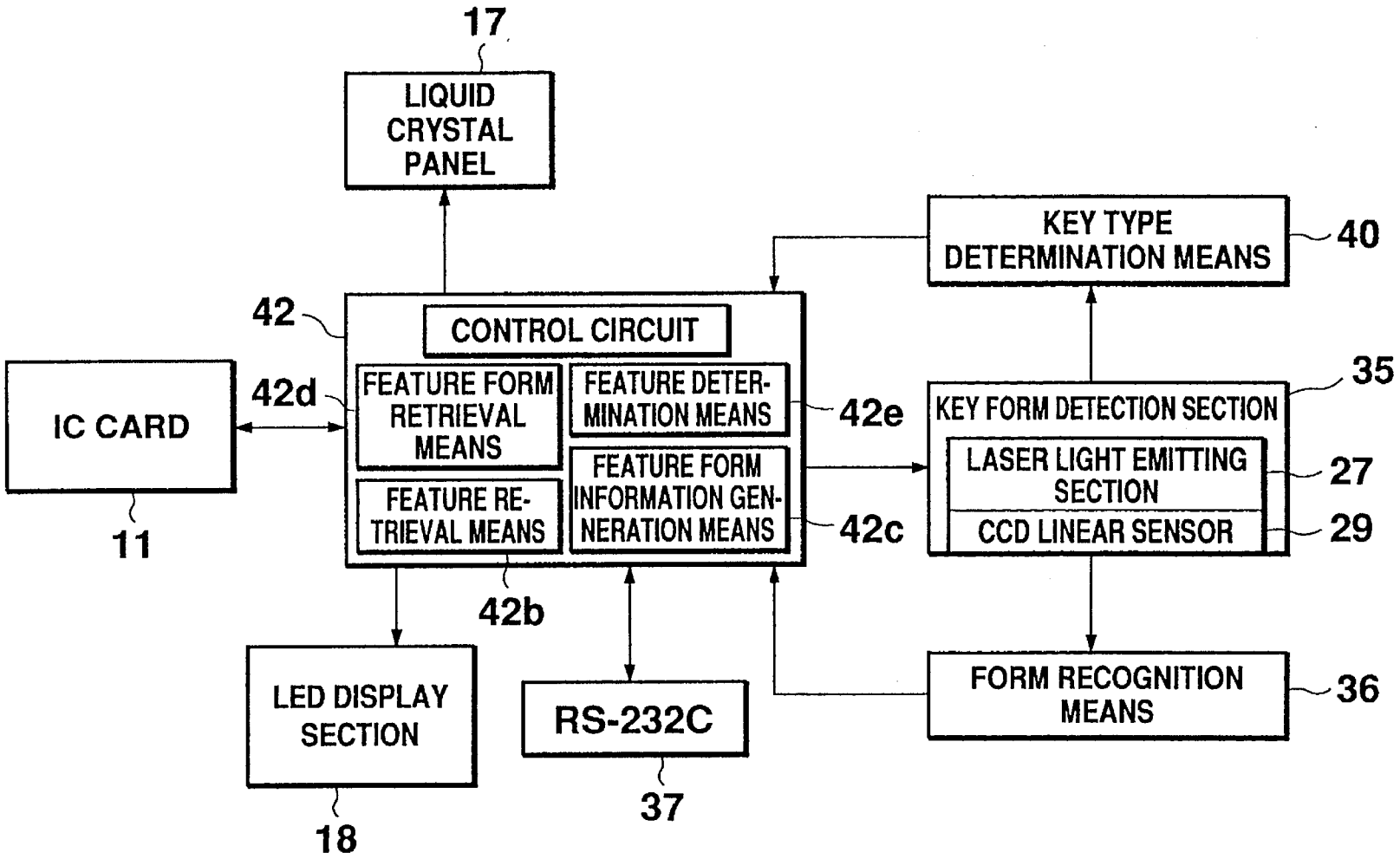
FIG. 12 is a block diagram of a key information processing section of a key plate examination apparatus according to a second embodiment of the invention.
Figure 13:
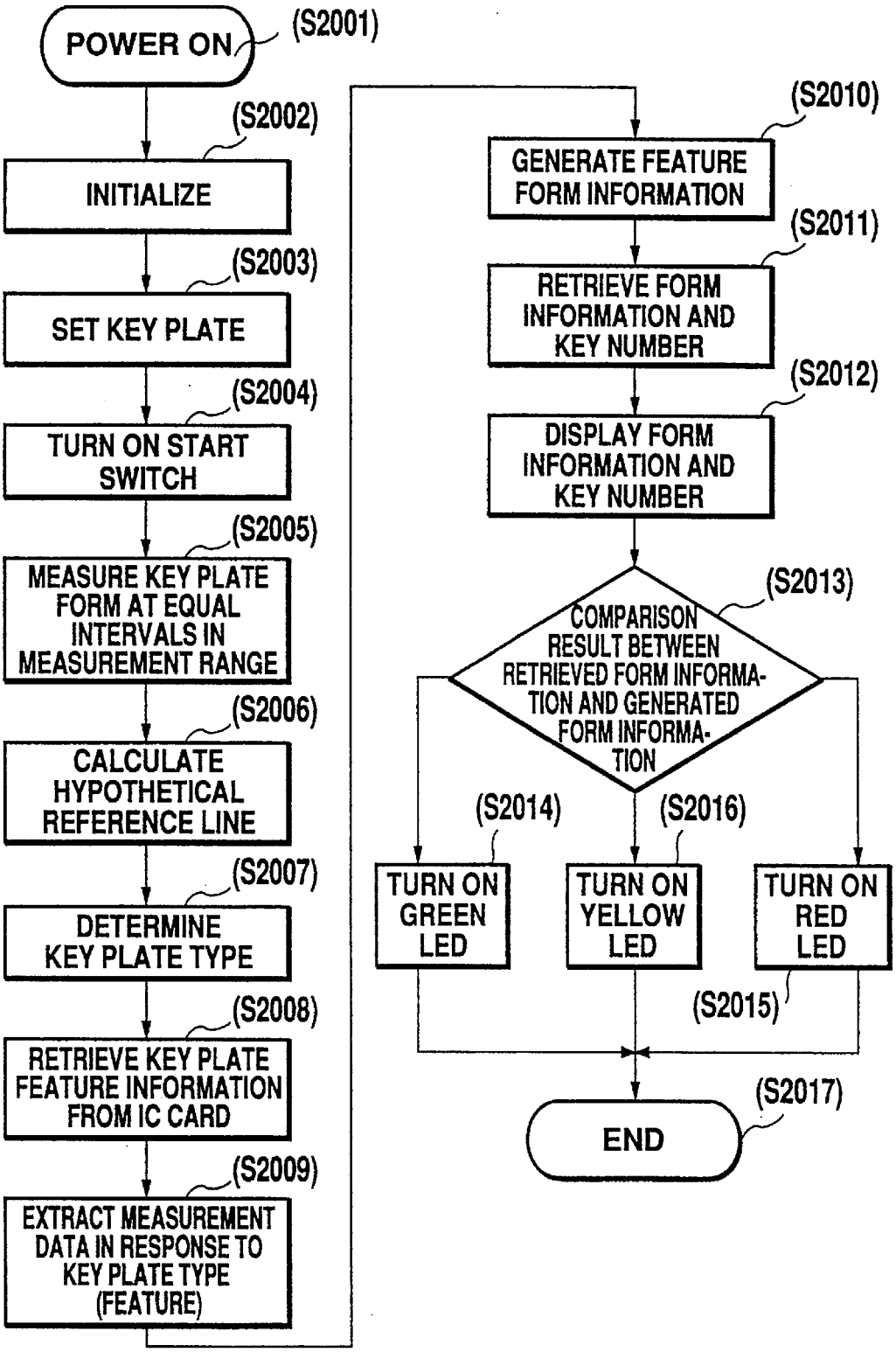
FIG. 13 is a flowchart of the operation of the key information processing section of the key plate examination apparatus according to the second embodiment of the invention.

A key plate examination apparatus according to a second embodiment of the invention will be described with reference to FIGS. 12 and 13. The key plate examination apparatus according to the second embodiment differs from that according to the first embodiment in that key number input is not required. That is, predetermined information, such as form information nearest to form information of a key plate recognized by form recognition means, is retrieved from a memory which stores information concerning key plates, and the recognized form information is compared with the retrieved form information to determine conformity. Therefore, form examination can be executed for key plates in the case where information, such as key numbers, is unknown.

The operation of the key plate examination apparatus according to the second embodiment of the invention will be described in detail in conjunction with FIG. 12 (block diagram) and FIG. 13 (flowchart). The mechanism is similar to that of the key plate examination apparatus according to the first embodiment and therefore will not be discussed again. Only a key information processing section is described. Parts identical with or similar to the key information processing section previously described with reference to FIG. 8 are denoted by the same reference numerals in FIG. 12 and will not be discussed again.

To retrieve predetermined form information from the memory based on the key plate form information recognized by the form recognition means and compare the recognized form information with the retrieved form information to determine their conformity, all recognized form information or only predetermined points in response to the key plate features can be compared with the retrieved form information for determination of their conformity. Here, the method of comparing only predetermined points with the retrieved form information for determination of their conformity is used for comprehensive description.

The key information processing section comprises a liquid crystal panel 17, IC card 11, key form detection section 35, form recognition means 36, LED display section 18, RS-232C interface 37 (for production control), key type determination means 40, control section 42, etc.

First, the IC card 11 containing a key information memory means storing key plate information, such as form information proper to each of the reference key plates and the key numbers corresponding to the form information, and a feature memory means storing feature information proper to each reference key plate type is inserted into the IC card slot 12 in FIG. 4. The main power switch 20 is then turned on at step S2001 to initialize the examination apparatus at step S2002. Key plate 13 is inserted through the key plate slot 14 into the key plate fixing section 25 for fixing the key plate 13 at step S2003. Examination start switch 19 is turned on at step S2004. When an examination is started, the key form detection section 35 moves a laser light emitting section 27 and a CCD linear sensor 29 by a predetermined move method and collects the form of the key plate 13 as electric signal in picture element units, as described in the first embodiment. In the second embodiment, the electric signal is collected at a predetermined pitch from the tip of the key plate 13 (for example, 0.1 mm pitch) at step S2005 independently of the key form. The collected electric signal is input to the form recognition means 36 for recognizing the form. Further, a hypothetical reference line is found based on the recognized form information at step S2006 for improving reliability of information comparison and determination described below.

To determine the type of key plate (such as car manufacturer and model if the key plate is a car ignition key), the key form detection section 35 also transmits and receives laser light to and from a predetermined feature part of the key plate, for example, the shoulder part of the key plate (even part on the key plate root, 13*a* in FIG. 6), and the key type determination means 40 determines the key type at step S2007. Subsequently, feature retrieval means 42*b* in the control section 42 retrieves feature information of the key plate 13 from the feature memory means in the IC card 11 in response to the determination result of the key type determination means 40 at step S2008. The feature information contains data, such as feature positions concerning measurement, for each key plate (for example, data indicating that feature forms exist at 2.1 mm intervals). Further, feature form information generation means 42*c* in the control section 42 extracts necessary form information from a large number of pieces of form information collected at the form recognition means 36 in response to the feature information at step S2009 and generates feature form information at step S2010.

Next, feature form retrieval means 42*d* in the control section 42 retrieves predetermined form information (in the embodiment, form information which is the same as or nearest to the feature form information) and the key number corresponding to the predetermined form information from the key information memory means in the IC card 11 in response to the feature form information generated by the feature form information generation means 42*c* at step S2011. Then, the form information and its corresponding key number retrieved by the feature form retrieval means 42*d* are displayed on the liquid crystal panel 17 at step S2012.

Determination means 42*e* in the control section 42 compares the feature form information generated by the feature form information generation means 42*c* with the form information retrieved by the feature form retrieval means 42*d* to determine their conformity at step S2013. As a result of the comparison, if the form of the key plate 13 is within the allowable error range of the reference key plate, the determination means 42*e* turns on a green LED on the LED display section 18 to indicate that the key plate 13 passes the form examination at step S2014. If the form of the key plate 13 is outside the allowable error range of the reference key plate, the determination means 42*e* turns on a red LED on the LED display section 18 to indicate that the key plate 13 falls the form examination at step S2015. At this time, if the determination as to whether it is good or bad is on the borderline, a yellow LED may be turned on as means for calling the operator's attention to trouble at key plate formation or examination, such as key cutter abrasion, improper key cutting method, or unskilled examination operation, at step S2016. Key information can be input/output by using the RS-232C interface 37 disposed as one of the communication means as required for production control of key plates at full-scale production.

When the examination of the key plate 13 ends at step S2017 and a new key plate is examined, a clear key (not shown) is pressed or the power switch 20 is again turned on for clearing the examination result for initialization at step S2002. The same steps for examination may be repeated by inputting a key number, or alternatively, it may be set to continue automatically.

In the second embodiment, the method of comparing only predetermined points with the retrieved form information in response to features for determination of their conformity has been discussed. To compare all form information recognized by the form recognition means 36 with the retrieved form information for determination of their conformity, steps S2007 to S2009 in the flowchart of FIG. 13 are deleted. Then, the form information generation means 42*c* generates form information considering all form information recognized by the form recognition means 36 and the form retrieval means 42*b* retrieves form information from the key information memory in response to the generated form information. Then, the generated form information is compared with the retrieved form information for determination of their conformity.

Figure 14:
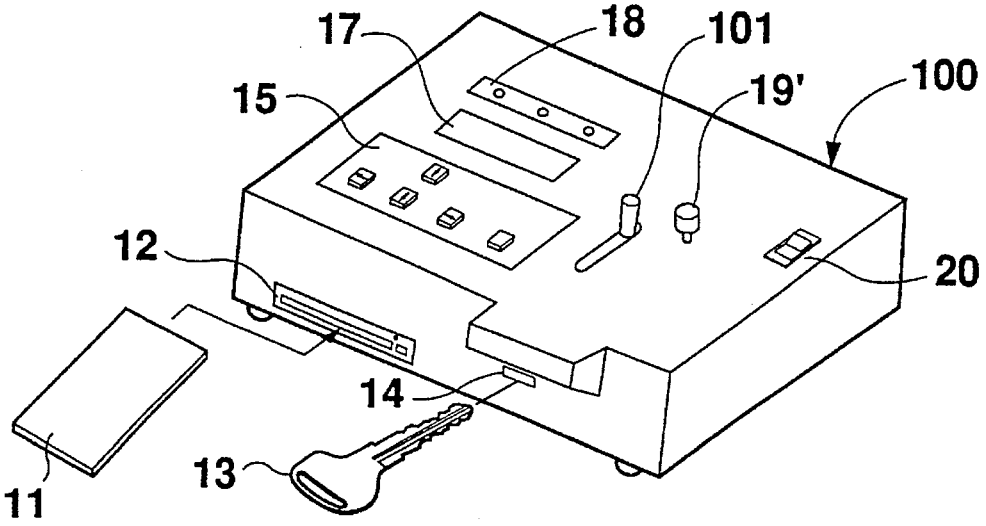
FIG. 14 is an external perspective view showing a key plate examination apparatus according to a third embodiment of the invention.

FIG. 14 shows an external perspective view of a reflection-type key plate examination apparatus 100 according to a third embodiment of the invention.

The transmission-type key plate examination apparatus according to the first embodiment can clearly recognize the form of an outer grooved key having irregularities on the outside like the examined key plate 13 shown in FIG. 4. However, it cannot recognize the form of an inner grooved key having irregularities excavated on one face side of the examined key plate. In this case, the reflection-type key plate examination apparatus as shown in the third embodiment is useful.

A mechanism of the reflection-type key plate examination apparatus 100 will be described in detail. The reflection-type key plate examination apparatus according to the third embodiment is almost the same as the transmission-type key plate examination apparatus according to the first embodiment except for allocation of a laser light emitting section and a CCD linear sensor of key form detection section. Therefore, parts identical with or similar to those previously described in the first embodiment are denoted by the same reference numerals in the third embodiment and will not be discussed again.

In the first embodiment, the key form detection section is moved by means of the motor. In the third embodiment, it is moved by using a spring and a damper, thus the key plate examination apparatus is formed with a move lever 101 for moving a slide block on which the key form detection section is placed.

Figure 15:
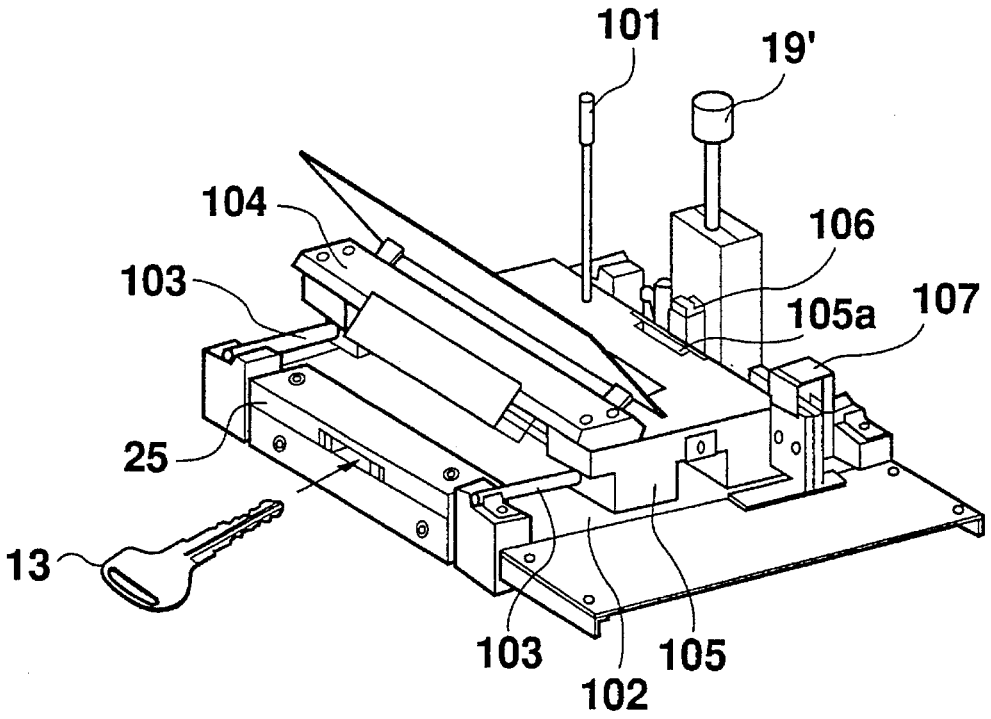
FIG. 15 is a schematic perspective view showing a mechanism of the key plate examination apparatus according to the third embodiment of the invention.

FIG. 15 shows a schematic perspective view of a mechanism of the key plate examination apparatus 100. Slide block 105 on which key form detection section 104 is mounted is located slidably on two guide shafts 103 fixed to a base plate 102. The guide shafts 103 are formed with a spring and damper (not shown); the spring is disposed so as to pull the slide block 105 toward a key plate fixing section 25 and the damper is disposed so as to brake it to enable the slide block 105 to be slid to the key plate fixing section 25 at low speed. First, the slide block 105 is moved by means of the move lever 101 against the energy of the spring and a ratchet 106 is caught on a notch 105*a* formed at the rear end of the slide block 105. Then, an examination start switch 19' is pressed and the ratchet 106 is taken off from the notch 105*a*. The spring and damper cause the slide block 105 to slide to the key plate fixing section 25 at low speed. At this time, a key plate 13 can be examined by the key form detection section.

Figure 16:
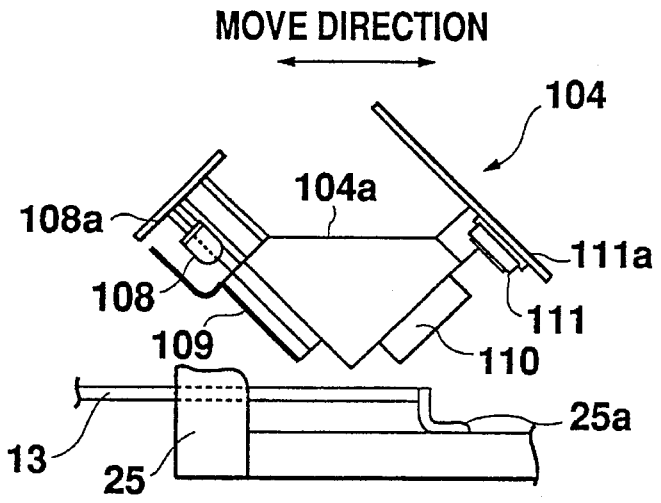
FIG. 16 is a side view of a key form detection section of the key plate examination apparatus according to the third embodiment of the invention.

FIG. 16 shows a mechanism of the key form detection section 104.

Fixed to a detector 104*a* are an LED 108 fixed to a bracket 108*a*, a slit 109 through which light of the LED 108 is passed for conversion to a narrow ray, a rod lens array 110, and a CCD linear sensor fixed to a bracket 111*a*. The light emitted from the LED 108 is passed through the slit 109 and the resultant narrow ray is directed to the key plate 13 fixed to the key plate fixing section 25. The light reflected on the surface of the key plate 13 is made incident on the rod lens array 110 for producing a 1:1 image on the CCD linear sensor 111, which then collects the key plate form provided by the reflected light on the surface of the key plate 13 as electric signal in picture element units. The key form detection section 104 is moved in the length direction of the key plate 13, thereby accurately collecting the entire form of the key plate 13 in picture element units (several μm).

Figure 17:
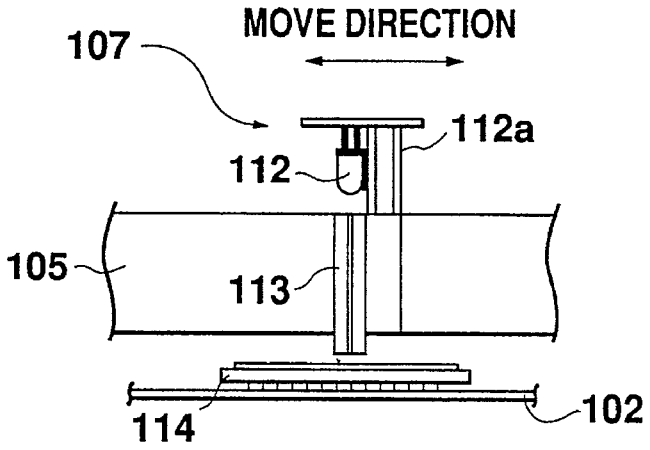
FIG. 17 is a side view showing the structure of a position detection section of the key plate examination apparatus according to the invention.

Since the spring and damper are used to move the key form detection section 104 in the embodiment, the move speed of the key form detection section varies and the measurement positions cannot be specified. In this case, a position detection section 107 is located in the slide block 105 as shown in FIG. 17. The position detection section 107 is made up of an LED 112 fixed to a bracket 112*a* located in the slide block 105, a slit 113, and a CCD linear sensor 114 fixed on the base plate 102.

Each picture element of the CCD linear sensor 114 is assigned with a clock and a control section (not shown) estimates that light of the LED 112 narrowed through the slit 113 passes on a specific picture element of the CCD linear sensor 114. When the light passes on the picture element at the position, the key form is detected. At the same time, the CCD linear sensor 114 estimates the next specific picture element and waits for the light of the LED 112 to come to that position. When the light passes on the picture element at the position, the CCD linear sensor 114 outputs a timing signal for detecting the key form. Thus, the light passing points are estimated one after another and a wait is made for the light to pass, thereby detecting the key form at the predetermined positions.

Figure 18:
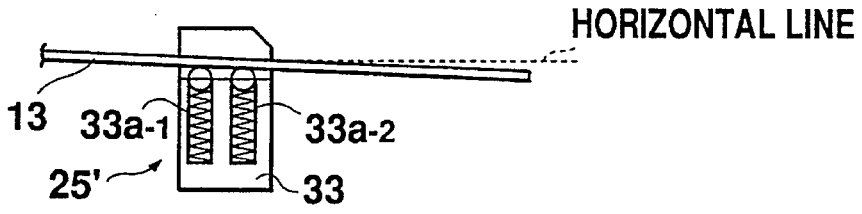
FIG. 18 is a drawing showing an example of a key plate fixing method of the key plate examination apparatus according to the invention.
Figure 19:
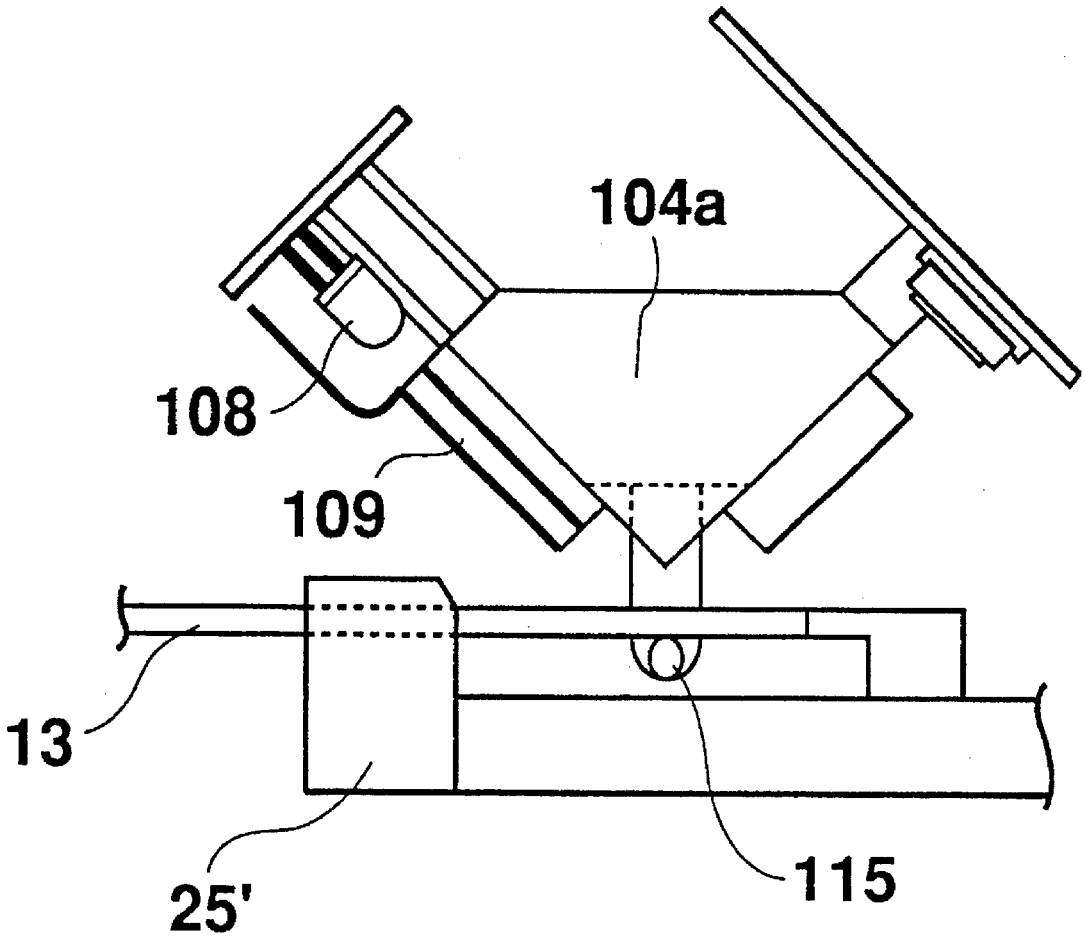
FIG. 19 is a drawing showing an example of a method for preventing the reflection direction or focus of a key plate from shifting in the key plate examination apparatus according to the invention.

With the reflection-type key plate examination apparatus in the embodiment, if the key plate 13 warps, the reflection direction and focus position of the reflected light of the key plate 13 shift, lowering measurement accuracy. In this case, as shown in FIG. 18, energy of the roller springs contained in a lower key clamp 33 of the key plate fixing section 25' is changed before and after and the key plate 13 is inclined downward with the horizontal line (broken line in the figure) as reference. That is, energy of the roller spring **33*a*-1 on the key plate insertion side is made stronger than that of the roller spring 33*a*-2 for setting a state in which the key plate 13 usually inclines downward, and as required, the key plate 13 is supported up and down slidably. In this case, since the warp of the key plate is about 0–0.4 mm at the tip, the key plate may be previously inclined about 1 mm downward considering the vertical warp. As shown in FIG. 19, the key plate 13 supported vertically slidably is lifted up from the downward position by means of a key plate reception roller 115 fixed to the detector 104*a* so that it can always be placed at predetermined irradiation position with light emitted from the LED 108 narrowed through the slit 109 for preventing the reflection direction or focus of the reflected light from shifting, thereby accurately measuring the form of the key plate 13**.

Thus, the reflection-type key plate examination apparatus 100 recognizes the form of an examined key plate in response to light reflected on the examined key plate. Therefore, it can precisely recognize the form of the examined key plate regardless of whether the examined key plate is an outer or inner grooved key.

The mechanism of the key plate examination apparatus in the third embodiment can be applied to both the measurement example in which key numbers are entered described with the first embodiment and the measurement example in which no key numbers are entered described in the second embodiment.

Although examination of car ignition keys is discussed in the first to third embodiments, the invention is not limited to examination of ignition keys and is also applicable to examination of any other type of key, such as house door keys and cashbox keys, etc.

According to one aspect of the invention, a key code can be retrieved from a key number, thus key information required to prepare spare keys can be retrieved based on the key number so that the spare keys can be machined easily and precisely in response to the retrieved key information. According to another aspect of the invention, the key form of a key plate whose key number is unknown is also recognized and from the recognized form information, form information and key number of the key plate can be estimated and retrieved. Therefore, even if the key number of a key plate is not known, spare keys of tile key plate can be machined easily and precisely.

Further, as described above, key information can be input/output via the RS-232C interface (for production control), thus the key information can be stored and production control, inventory control, quality control, etc., of key plates can also be provided.

What is claimed is:

1. A key plate examination apparatus for comparing an object key plate formed from a key blank with one of a plurality of reference key plates to determine a degree of conformity between said object key plate and said reference key plate, said examination apparatus comprising:

means for recognizing a form of said object key plate by imaging said object key plate along a lengthwise side profile thereof so that relative locations of peaks and valleys of along a length of said object key plate are established;

means for generating object key form information based on form information output from said recognizing means;

memory means for storing key information including reference key form information associated with each reference key plate and a key number corresponding to said reference key form information for each reference key plate in said plurality of reference key plates;

means for retrieving, responsive to a key number input externally, reference key form information corresponding to said input key number from said memory means;

determination means for comparing said object key form information generated by said object key form information generating means with said reference key form information retrieved by said retrieving means to determine said degree of conformity therebetween based on said peaks and valleys along said length of said object key plate and associated features of one of said reference key plates in order to establish whether said object key plate has been manufactured from said key blank with a sufficient level of precision so as to be substantially identical to an associated reference key plate; and means for communicating a result of said determination means.

2. The key plate examination apparatus as claimed in claim 1, further comprising:

light emitting means for irradiating said object key plate with light; and means for receiving said light reflected by said object key plate, wherein said form recognizing means recognizes said form of said object key plate in response to said light received by said light receiving means.

3. The key plate examination method as claimed in claim 1, wherein said form recognizing means recognizes said form of said object key plate at a plurality of points at each of a plurality of form recognition positions along said length of said object key plate and adopts a value of a middle one of said plurality of points at each form recognition position as said form of said object key plate at that form recognition position.

4. The key plate examination method as claimed in claim 1, wherein said form recognizing means determines a hypothetical reference line along said length of said object key plate and recognizes said form of said object key plate based on said hypothetical reference line.

5. A key plate examination apparatus for comparing an object key plate formed from a key blank with one of a plurality of reference key plate to determine a degree of conformity between said object key plate and said reference key plate, said examination apparatus comprising:

means for recognizing a form of said object key plate by imaging said object key plate along a lengthwise side profile thereof so that relative locations of peaks and valleys along a length of said object key plate are established;

means for generating object key form information based on form information output from said recognizing means;

memory means for storing reference key form information including reference key form information associated with said reference key plate and a key number corresponding to said reference key form information for each reference key in said plurality of reference key plates;

means for retrieving predetermined reference key form information and a key number corresponding to said reference key form information from said memory means in response to said object key form information generated by said object key form information generating means;

means for comparing said object key form information with said reference key form information retrieved by said form retrieval means to determine said degree of conformity therebetween based on said peaks and valleys along said length of said object key plate and associated features of one of said reference key plates in order to establish whether said object key plate has been manufactured from said key blank with a sufficient level of precision so as to be substantially identical to an associated reference key plate; and means for communicating a result of said determination means.

6. The key plate examination apparatus as claimed in claim 5, further comprising:

light emitting means for irradiating said object key plate with light; and means for receiving said light reflected by said object key plate, wherein said form recognizing means recognizes said form of said object key plate in response to said light received by said light receiving means.

7. The key plate examination method as claimed in claim 5, wherein said form recognizing means recognizes said form of said object key plate at a plurality of points at each of a plurality of form recognition positions along said length of said object key plate and adopts a value of a middle one of said plurality of points at each form recognition position as said form of said object key plate at that form recognition position.

8. The key plate examination method as claimed in claim 5, wherein said form recognizing means determines a hypothetical reference line along said length of said object key plate and recognizes said form of said object key plate based on said hypothetical reference line.

9. A key plate examination apparatus for comparing an object key plate formed from a key blank with one of a plurality of reference key plates to determine a degree of conformity between said object key plate and said reference key plate, said examination apparatus comprising:

means for recognizing a form of said object key plate by imaging said object key plate along a lengthwise side profile thereof so that relative locations of peaks and valleys along a length of said object key plate are established;

memory means for storing reference key feature information associated with each reference key plate type;

another memory means for storing reference key form information including reference key form information associated with each reference key plate and a key number corresponding to said reference key form information;

means for determining a type of said object key plate based on object key form information output by said recognizing means;

means responsive to a result of said determining means for retrieving feature information corresponding to said object key plate from said memory means;

means for generating feature form information from said feature information retrieved by said retrieving means and an output of said recognizing means;

means for retrieving predetermined reference key form information and a key number corresponding to said reference key form information from said another memory means in response to said feature form information generated by said feature form information generating means;

determining means for comparing said feature form information generated by said feature form information generating means with said reference key form information retrieved by said feature form retrieval means to determine said degree of conformity therebetween based on said peaks and valleys along said length of said object key plate and associated features of one of said reference key plates in Order to establish whether said object key plate has been manufactured from said key blank with a sufficient level of precision so as to be substantially identical to an associated reference key plate; and means for communicating a determination result of said feature determination means.

10. The key plate examination apparatus as claimed in claim 9, further comprising:

light emitting means for irradiating said object key plate with light; and means for receiving said light reflected by said object key plate, wherein said form recognizing means recognizes said form of said object key plate in response to said light received by said light receiving means.

11. The key plate examination method as claimed in claim 9, wherein said form recognizing means recognizes said form of said object key plate at a plurality of points at each of a plurality of form recognition positions along said length of said object key plate and adopts a value of a middle one of said plurality of points at each form recognition position as said form of said object key plate at that form recognition position.

12. The key plate examination method as claimed in claim 9, wherein said form recognizing means determines a hypothetical reference line along said length of said object key plate and recognizes said form of said object key plate based on said hypothetical reference line.

13. A key plate examination method for comparing an object key plate formed from one of a plurality of key blanks with one of a plurality of reference key plates to determine a degree of conformity between said object key plate and said reference key plate, said method comprising the steps of:

recognizing a form of said object key plate by imaging said object key plate along a lengthwise side profile thereof so that relative locations of peaks and valleys along a length of said object key plate are established;

generating object key form information based on image information output from said recognizing step;

retrieving, responsive to a key number input externally, reference key form information corresponding to an input key number from a memory means which stores key information including reference key form information associated with each reference key plate and a key number corresponding to said reference key form information;

comparing said object key form information generated in said object key form information generating step with reference key form information retrieved in said reference key form information retrieving step to determine said degree of conformity therebetween based on said peaks and valleys along said length of said object key plate and associated features of one of said reference key plates in order to establish whether said object key plate has been manufactured from said key blank with a sufficient level of precision so as to be substantially identical to an associated reference key plate.

14. The key plate examination method as claimed in claim 13, further comprising the steps of:

irradiating said object key plate with light; and receiving said light reflected by said object key plate, wherein said form recognizing step recognizes said form of said object key plate in response to said light received.

15. The key plate examination method as claimed in claim 13, wherein said recognizing step includes recognizing said form of said object key plate at a plurality of points at each of a plurality of form recognition positions along said length of said object key plate and adopting a value of a middle one of said plurality of points at each form recognition position as said form of said object key plate at that form recognition position.

16. The key plate examination method as claimed in claim 13, wherein said form recognizing step includes determining a hypothetical reference line along said length of said object key plate and recognizes said form of said object key plate based on said hypothetical reference line.

17. A key plate examination method for comparing an object key plate formed from one of a plurality of key blanks with one of a plurality of reference key plates to determine a degree of conformity between said object key plate and said reference key plate, said method comprising the steps of:

recognizing a form of said object key plate by imaging said object key plate along a lengthwise side profile thereof so that relative locations of peaks and valleys along a length of said object key plate are established;

generating object key form information in response to said object key plate form recognized in said form recognizing step;

retrieving, from a memory in response to said object key plate form information generated in said object key form information generating step, predetermined reference key form information and a key number corresponding to to said reference key form information, said memory storing reference key information including reference key form information associated with each reference key plate and a key number corresponding to said reference key form information for each reference key plate in said plurality of reference key plates; and comparing said object key form information generated in said object key form information generating step with said reference key form information retrieved in said reference key form information retrieving step to determine said degree of conformity therebetween based on said peaks and valleys along said length of said object key plate and associated features of one of said reference key plates in order to establish whether said object key plate has been manufactured from said key blank with a sufficient level of precision so as to be substantially identical to an associated reference key plate.

18. The key plate examination method as claimed in claim 17, further comprising the steps of:

irradiating said object key plate with light; and receiving said light reflected by said object key plate, wherein said form recognizing step recognizes said form of said object key plate in response to said light received.

19. The key plate examination method as claimed in claim 17, wherein said form recognizing step includes determining a hypothetical reference line along said length of said object key plate and recognizes said form of said object key plate based on said hypothetical reference line.

20. A key plate examination method for comparing an object key plate formed from one of a plurality of key blanks with one of a plurality of reference key plates to determine a degree of conformity between said object key plate and said reference key plate, said method comprising the steps of:

recognizing a form of said object key plate by imaging said object key plate along a lengthwise side profile thereof so that relative locations of peaks and valleys along a length of said object key plate are established;

determining a type of said object key plate based on object key form information generated in said recognizing step;

retrieving, responsive to a result in said determining step, feature information corresponding to said object key plate from a first memory means which stores feature information associated with each reference key plate type;

generating feature form information based on said feature information retrieved in said retrieving step and said known key form information recognized in said recognizing step;

retrieving, in response to said feature form information generated in said generating step, predetermined reference key form information and a key number corresponding to said reference key form information from a second memory means which stores key information including reference key form information associated with each reference key plate and a key number corresponding to said reference key form information; and comparing said feature form information generated in said generating step with reference key form information retrieved in said reference key form information retrieving step to determine said degree of conformity therebetween based on said peaks and valleys along said length of said object key plate and associated features of one of said reference key plates in order to establish whether said object key plate has been manufactured from said key blank with a sufficient level of precision so as to be substantially identical to an associated reference key plate.

21. The key plate examination method as claimed in claim 20, further comprising the steps of:

irradiating said object key plate with light; and receiving said light reflected by said object key plate, wherein said form recognizing step recognizes said form of said object key plate in response to said light received.

22. The key plate examination method as claimed in claim 20, wherein said form recognizing step includes determining a hypothetical reference line along said length of said object key plate and recognizes said form of said object key plate based on said hypothetical reference line.

* * * * *